US007086762B2

(12) United States Patent
Nicholas

(10) Patent No.: US 7,086,762 B2
(45) Date of Patent: Aug. 8, 2006

(54) COLLAPSIBLE CHANDELIER

(75) Inventor: Kenneth J. Nicholas, Parma, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 11/034,148

(22) Filed: Jan. 12, 2005

(65) Prior Publication Data

US 2006/0152929 A1 Jul. 13, 2006

(51) Int. Cl.
*F21V 21/108* (2006.01)

(52) U.S. Cl. ..... 362/405; 362/427

(58) Field of Classification Search ..... 362/405, 362/406, 427, 147, 457
See application file for complete search history.

(56) References Cited

U.S. PATENT DOCUMENTS

| | | | | |
|---|---|---|---|---|
| 402,077 | A | 4/1889 | Griswold | |
| 1,012,234 | A | 12/1911 | Beardslee | |
| 1,014,897 | A | 1/1912 | Neuhoefer et al. | |
| 1,016,317 | A | 2/1912 | Benjamin | |
| 1,024,809 | A | 4/1912 | Sechrist | |
| 1,031,241 | A | 7/1912 | Camp | |
| 1,059,742 | A | 4/1913 | Lumley | |
| 2,279,035 | A | 4/1942 | Elting | |
| 3,735,123 | A | 5/1973 | Porter et al. | |
| 3,831,022 | A | 8/1974 | Porter et al. | |
| 4,079,244 | A | 3/1978 | Bortoluzzi | |
| 4,107,770 | A | 8/1978 | Weber | |
| 4,477,866 | A | 10/1984 | Goralnik | |
| 4,748,549 | A | 5/1988 | Scheer | |
| 5,475,578 | A | 12/1995 | Sevack et al. | |
| 5,620,248 | A | 4/1997 | Sevack et al. | |
| 6,966,678 | B1 * | 11/2005 | Hsieh | 362/406 |
| 2005/0088846 | A1 | 4/2005 | Hsu | |

OTHER PUBLICATIONS

PCT WO 97/49949 to Fabbian et al., published Dec. 31, 1997.*

* cited by examiner

*Primary Examiner*—Laura Tso
(74) *Attorney, Agent, or Firm*—Calfee, Halter & Griswold LLP

(57) ABSTRACT

A collapsible chandelier comprises multiple lamp arms pivotally attached to the central frame of the lamp so that they are moveable between use positions and a storage position in which an overall dimension of the chandelier is reduced. The attaching portions of these support arms are in the form of hollow conduit sections, whereby the structural integrity of lamp is enhanced.

16 Claims, 11 Drawing Sheets

COLLAPSIBLE CHANDELIER

FIELD OF THE INVENTION

The present invention relates generally to lighting fixtures and portables, and more particularly to so-called knock-down ("KD") fixtures and portables.

BACKGROUND AND SUMMARY OF THE INVENTION

Knock-down lighting fixtures in which multiple lamp arms can be made more compact for storage and shipment by pivotally mounting the arms to the central frame of the fixture are known. See, for example, U.S. Pat. No. 3,831,022.

In accordance with the invention, the structural integrity of such a chandelier is enhanced by fabricating the portion of each lamp arm which pivotally mounts to the central frame as a hollow conduit section.

Thus, the present invention provides in one exemplary aspect a collapsible chandelier comprising a generally vertical upright, a support hub attached to the upright, and multiple lamp arms having distal ends for carrying lamp sockets, the lamp arms defining attaching portions at or near their proximal ends for pivotal attachment to the support hub so that the lamp arms are moveable between use positions and a storage position in which an overall dimension of the chandelier is reduced, wherein the attaching portion of at least one lamp arm is in the form of a hollow conduit section, this hollow conduit section being pivotally attached to the support hub by means of a pivotal mounting assembly defining a pivot axis essentially perpendicular to the central axis of the hollow conduit section.

In another exemplary aspect of the invention, decorative cross-members extend between each lamp arm and the central frame, the bottom of each decorative upright being received by an upwardly extending nipple in the associated lamp arm while the top of the decorative upright is received in a downwardly facing opening of the central frame whereby each decorative cross-member is held in position by gravity only while still being easily removable and reinsertable by raising the upright to clear the nipple.

BRIEF DESCRIPTION OF THE DRAWINGS

The present invention may be more readily understood by reference to the following drawings wherein.

DETAILED DESCRIPTION

Figure 1:
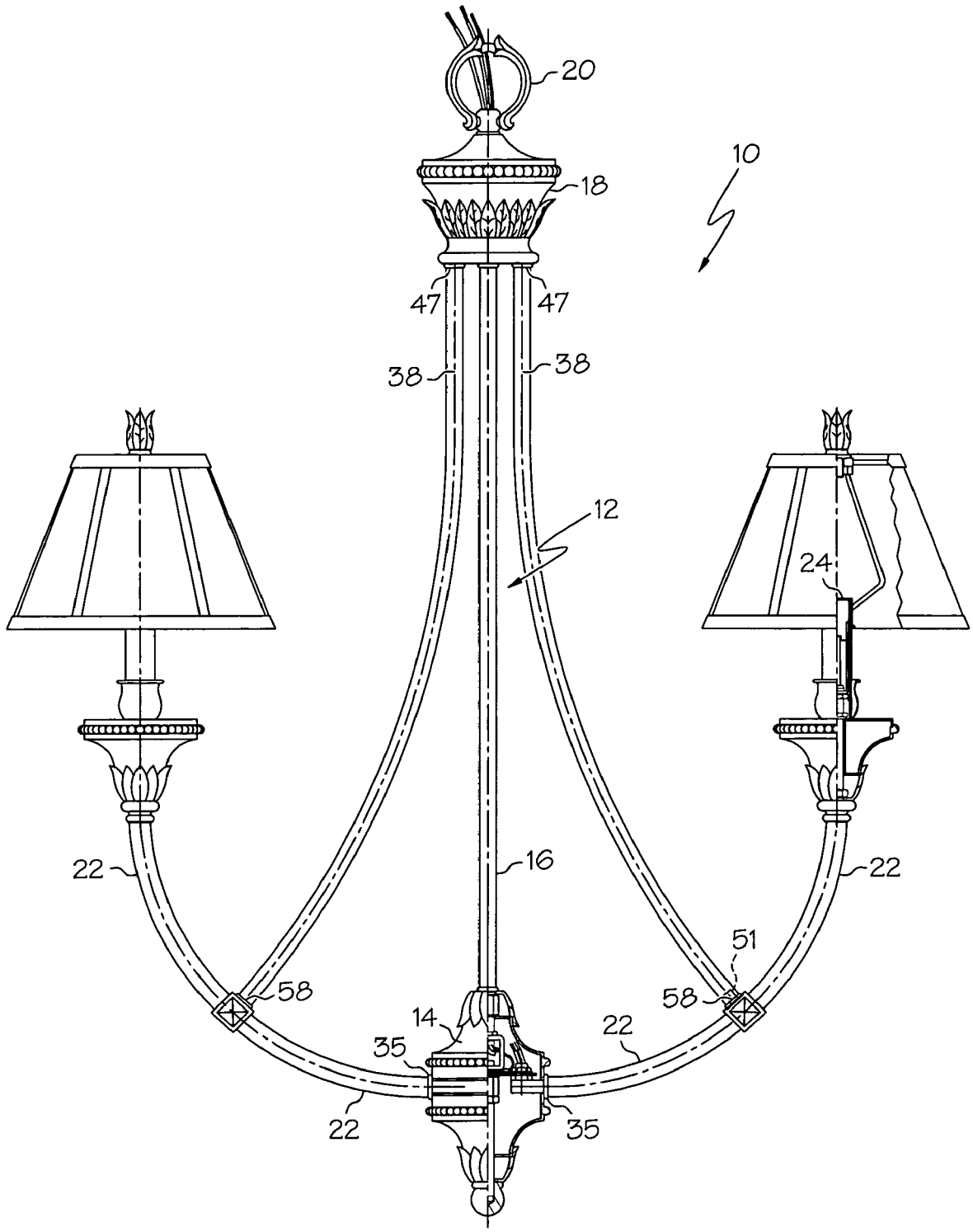
FIG. 1 is a side view of the inventive collapsible chandelier, partly in cross-section, showing the chandelier in its in-use configuration.

As shown in FIGS. 1–7, the inventive collapsible chandelier 10 in one embodiment includes a central frame 12, which, in the exemplary embodiment shown, is composed of lower or support hub 14, upright 16 and upper or secondary hub 18. A fastener in the form of ring 20 is provided to allow chandelier 10 to be suspended from a ceiling whereby upright 16 will assume a generally vertical orientation with secondary hub 18 being located generally above support hub 14. Any other structure which will support chandelier 10 with upright 16 being in a generally vertical orientation can also be used in lieu of ring 20, as will be well appreciated by those skilled in the art.

Attached to support hub 14 are multiple lamp arms 22, each of which is provided with a socket 24 for receiving an electric lamp (not shown). Electric wires (not shown), which extend from each socket 24 through associated lamp arms 22, are received in support hub 14. These wires are electrically connected to a supply wire (not shown) attached to a source of electricity in the ceiling to which the inventive chandelier is mounted. This connection can occur anywhere in central frame 12, for example in lower hub 14, upright 16 and/or upper hub 18, as desired.

Figure 2:
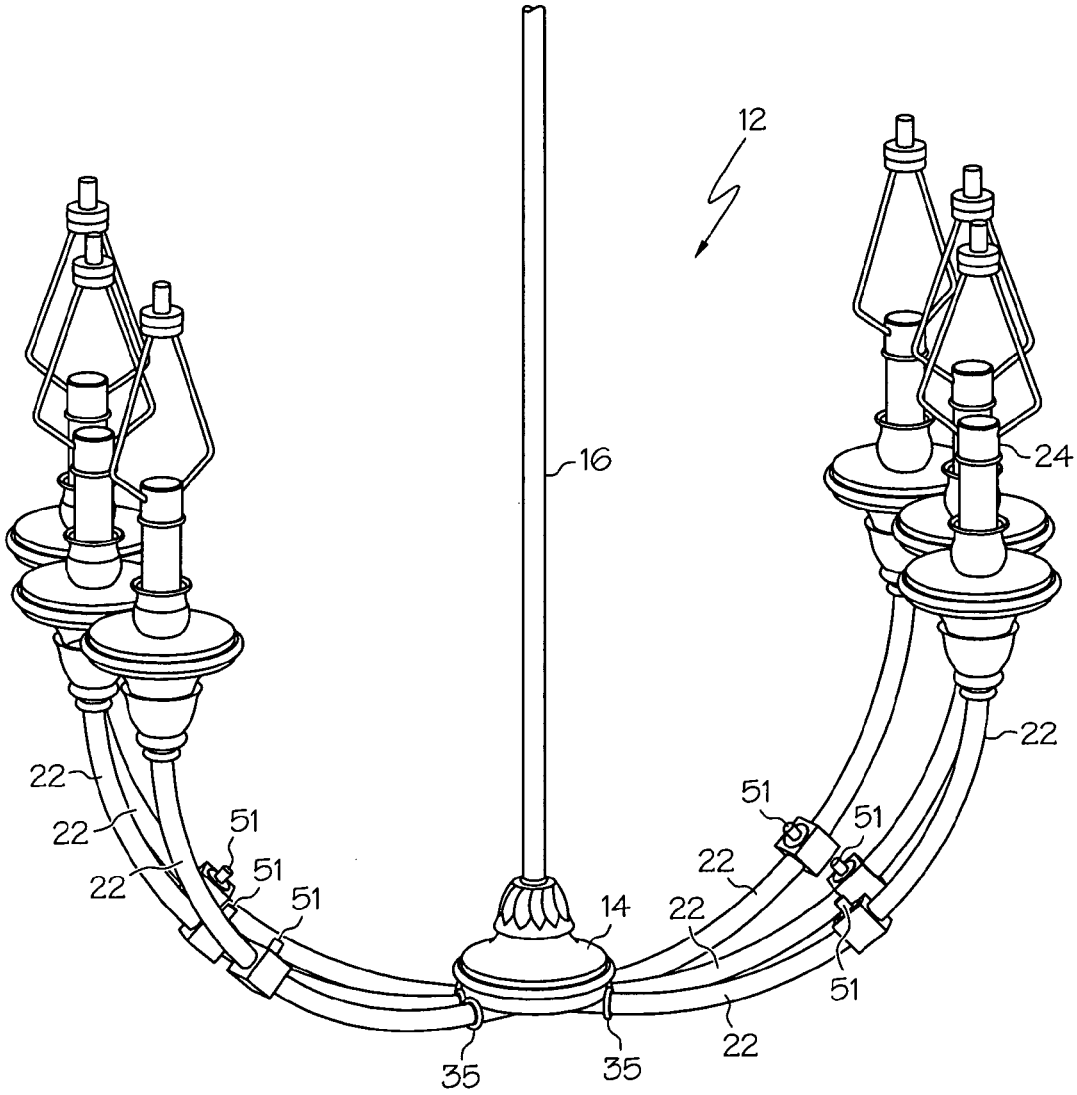
FIG. 2 is a perspective view showing the collapsible chandelier of FIG. 1 in its storage configuration.
Figure 6:
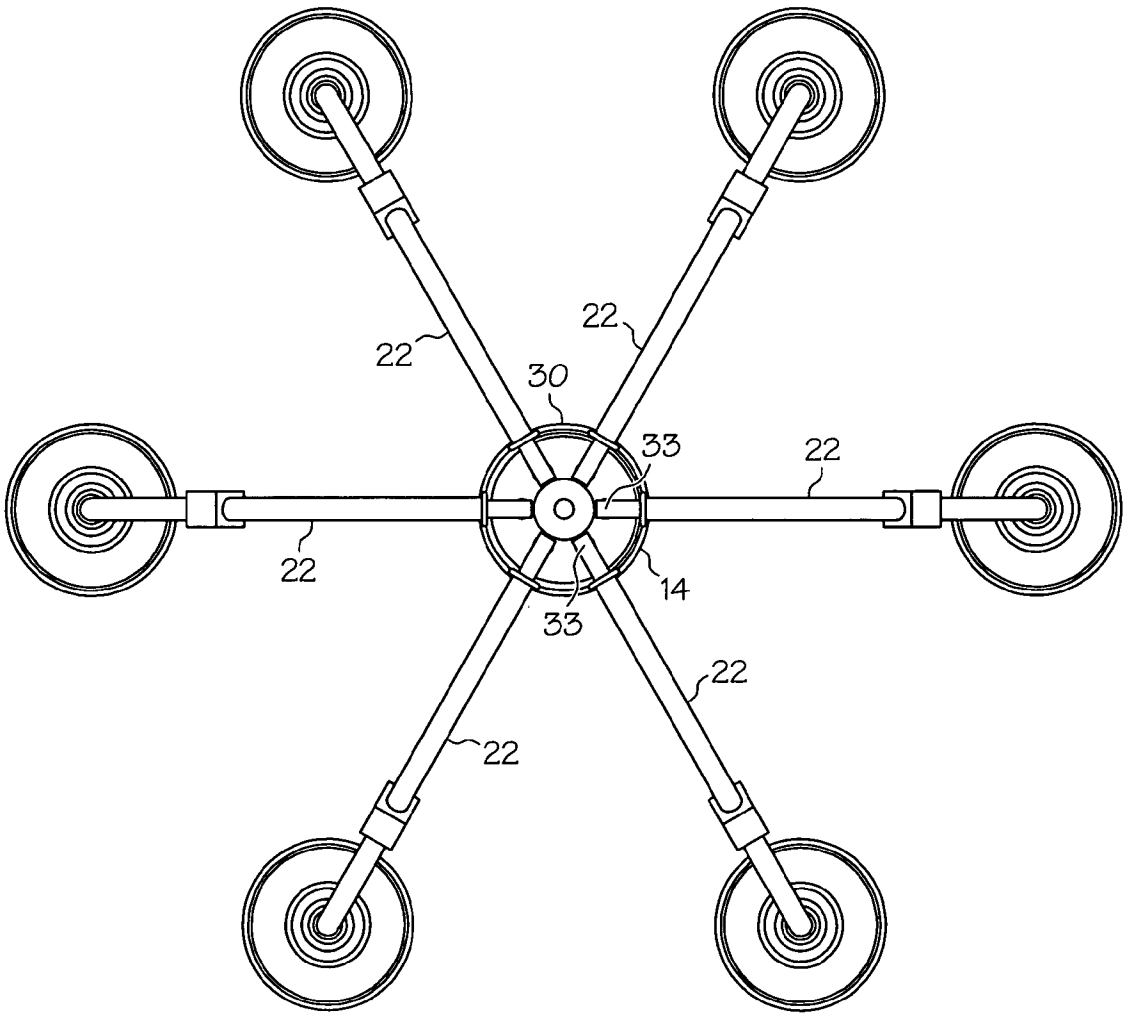
FIG. 6 is a bottom view showing how the lamp arms of the collapsible chandelier of FIGS. 1–5 are pivotally attached to its support hub.
Figure 7:
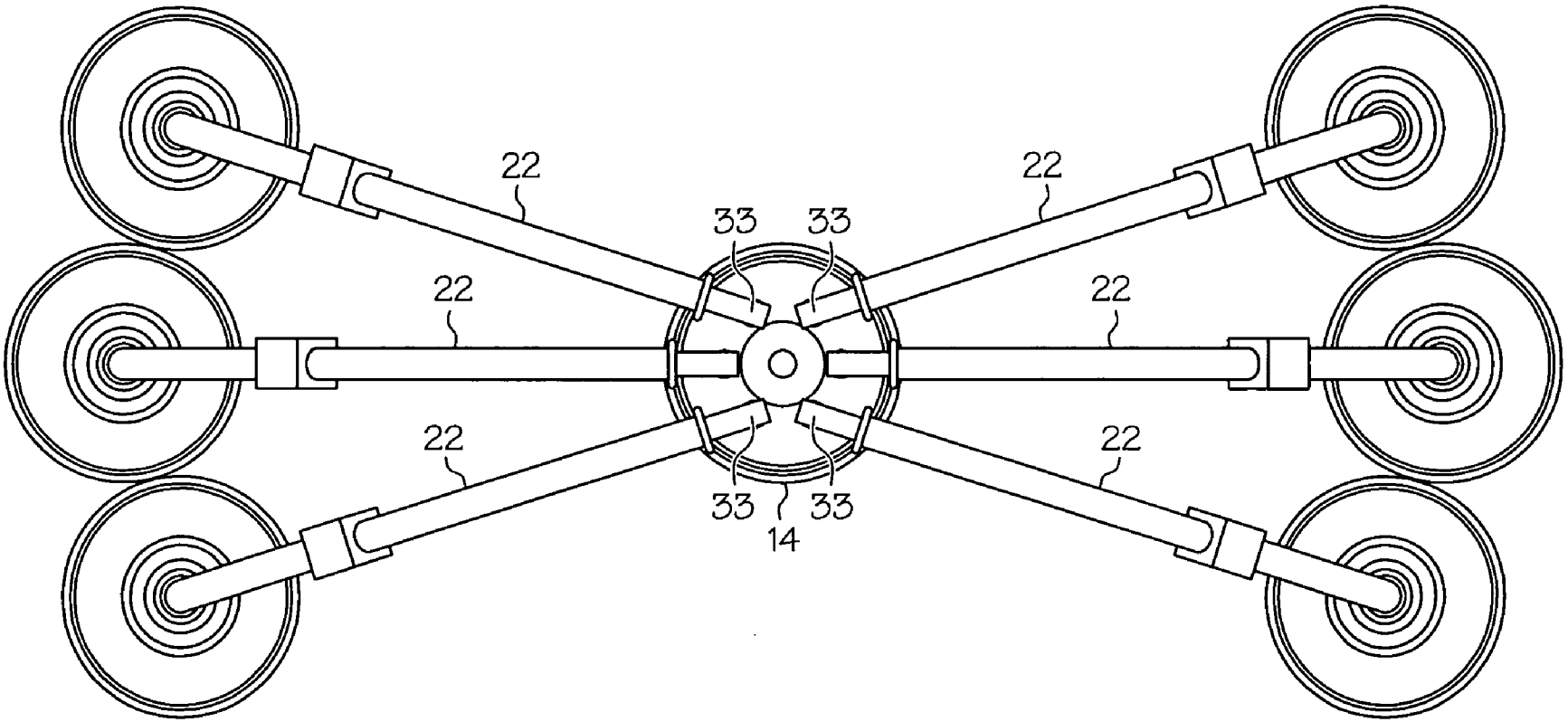
FIG. 7 is a bottom view similar to FIG. 6, showing the lamp arms in their storage position.

Lamp arms 22 are pivotally attached at or near their proximal ends to support hub 14 at pivotal junctions 33 (FIG. 6) so as to be moveable between a use position, as illustrated in FIGS. 1 and 6 in which they are essentially evenly spaced about support hub 14 (and hence the vertical axis of the chandelier), and a storage position, as shown in FIGS. 2 and 7, in which they are closer together. By this means, the overall size of chandelier 10 in at least one dimension (its width in the particular embodiment shown) can be easily reduced for packaging, storage and/or shipment.

In the particular embodiment shown, there are six lamp arms 22 and all six lamp arms 22 are pivotally mounted in support hub 14. In other embodiments, more or less arms may be used and less than all lamp arms can be pivotally mounted. Indeed, five, four, three or two lamp arms can be mounted in this way. Indeed, so long as at least one lamp arm 22 is mounted in this way, an overall dimension of the chandelier can be reduced by pivoting the lamp arm from its use to its storage position.

Moreover, although the above embodiment shows six lamp arms being evenly spaced around the chandelier's central hub 14 when in an in-use configuration, any number of lamp arms can be provided whether evenly spaced or unevenly spaced about the chandelier's central frame. In addition, pivotally mounted socket lamp arms 22 can be provided on multiple levels, i.e., different groups of lamp arms can be attached to support hubs located in different locations, e.g., at different vertical levels, if desired.

In order to secure lamp arms 22 in place when chandelier 10 is in its in-use configuration, stabilizer 26 is provided. See, FIGS. 3A, 3B and 3C. In the particular embodiment shown, stabilizer 26 is a cup-shaped bracket having an upwardly facing rim 28 which is shaped to closely fit under corresponding downwardly facing rim 30 of hub 14. See, FIGS. 3A, 3B and 3C. Multiple detents 32 are provided in upwardly facing rim 28 of bracket 26, one for each lamp arm 22, for securing these arms in position when the chandelier is in its in-use configuration. Preferably, each detent is shaped and sized to correspond to the outside configuration of its associated lamp arm so that the pivotal junctions 33 between each lamp arm 22 and hub 14 are hidden from view when cup-shaped bracket 26 is attached to hub 14. In the particular embodiment shown, the detents 32 are rectangular to correspond to a corresponding rectangular lamp arm. Also, as shown each lamp arm carries an annular bead 35 closely adjacent upwardly facing rim 28 of bracket 26. This bead 35, together with the close fitting of detents 32, make lamp arms 22 appear to be solidly secured to, and rigid with respect to, the structure formed by bracket 26/hub 14.

Figure 3A:
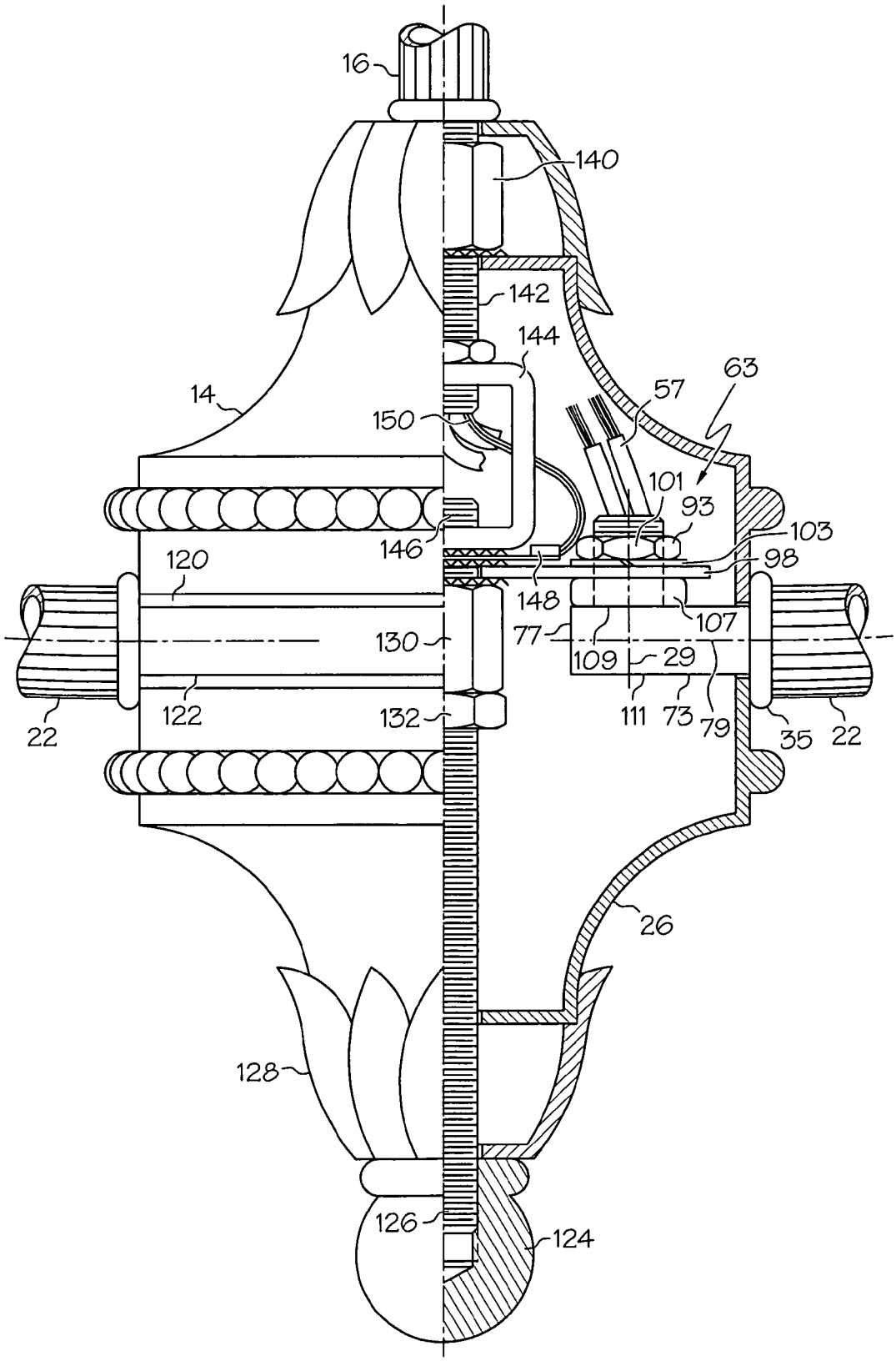
FIGS. 3A, 3B and 3C are a side view, exploded side view and perspective view, respectively, of the collapsible chandelier of FIGS. 1 and 2 showing how its lamp arms are mounted to its central frame.
Figure 3B:
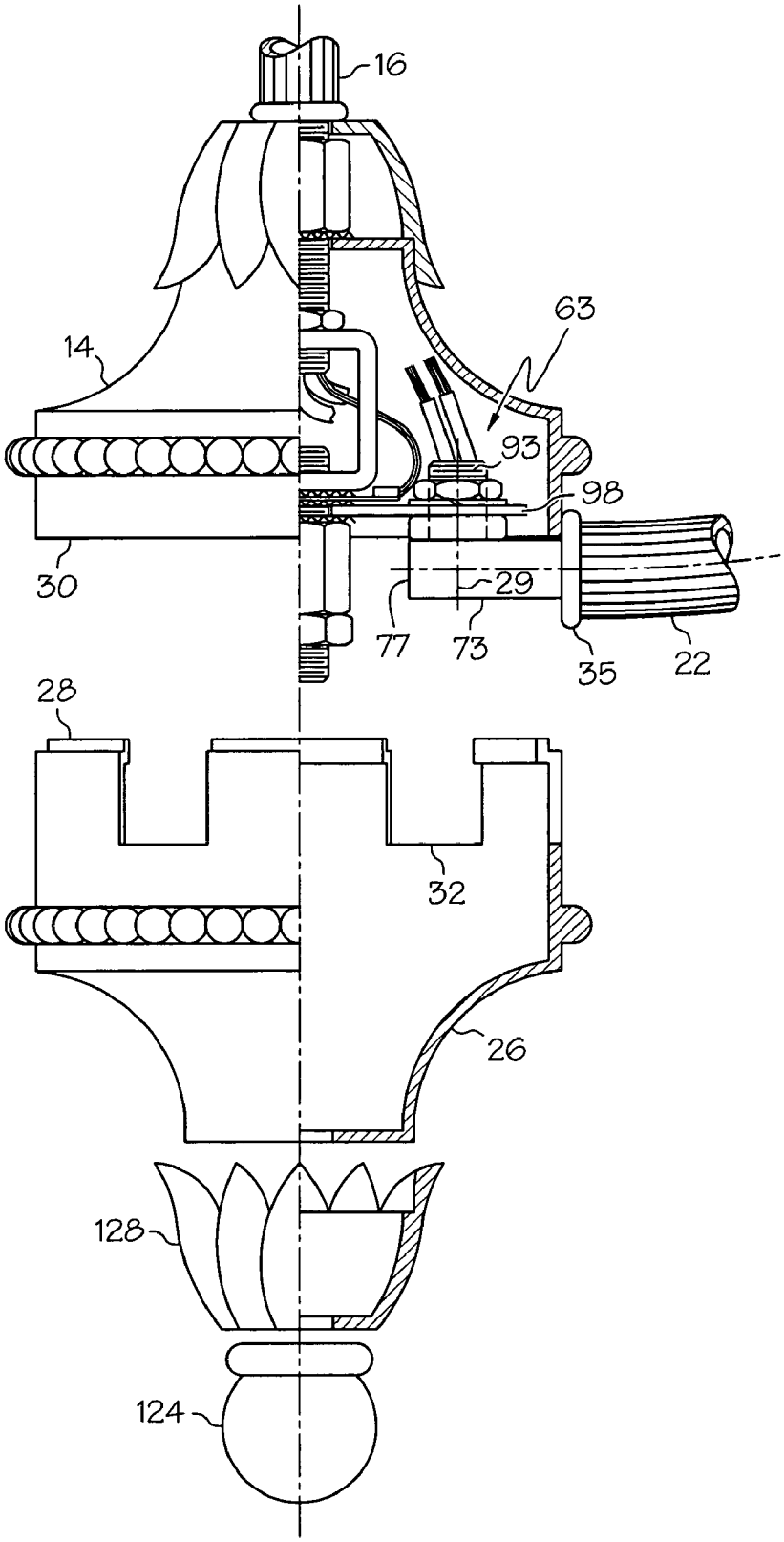
Figure 3C:
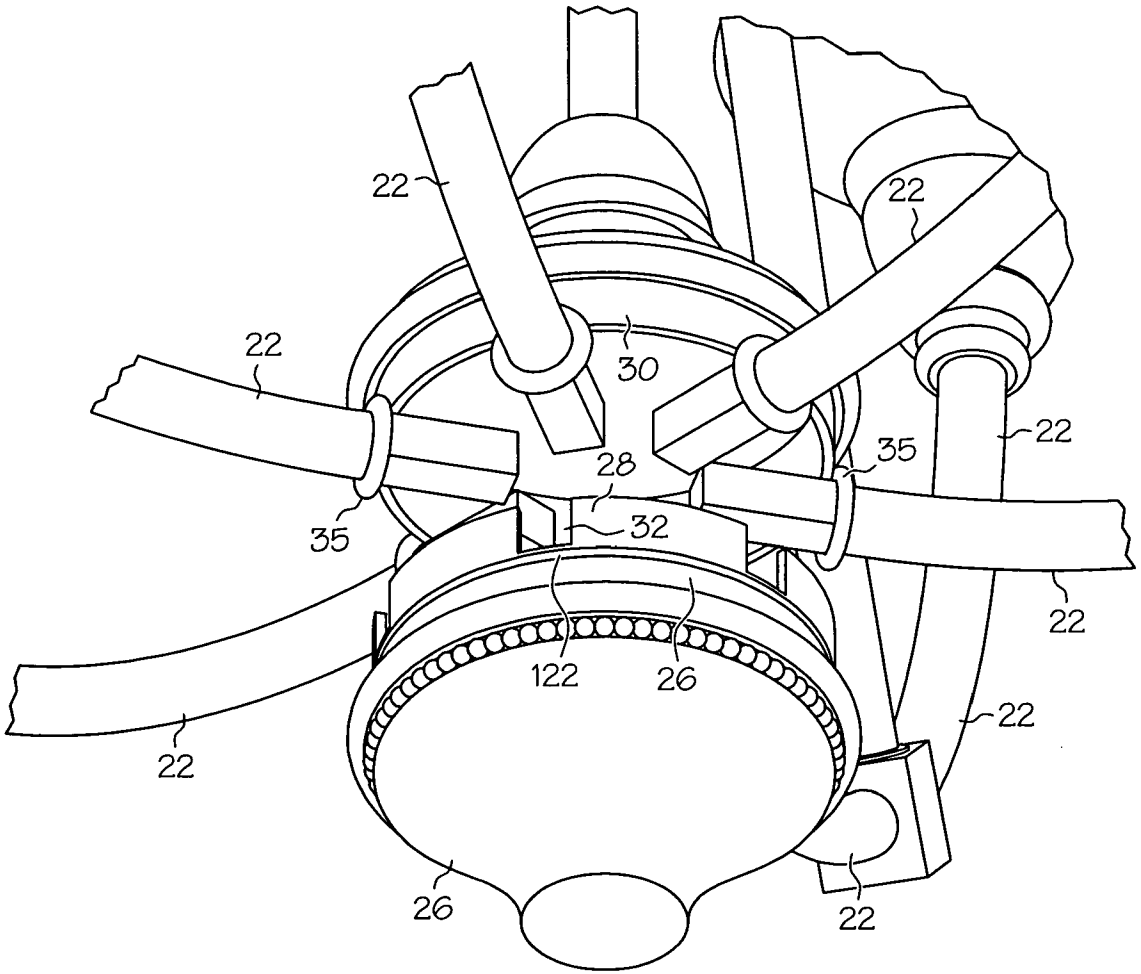
Figure 4B:
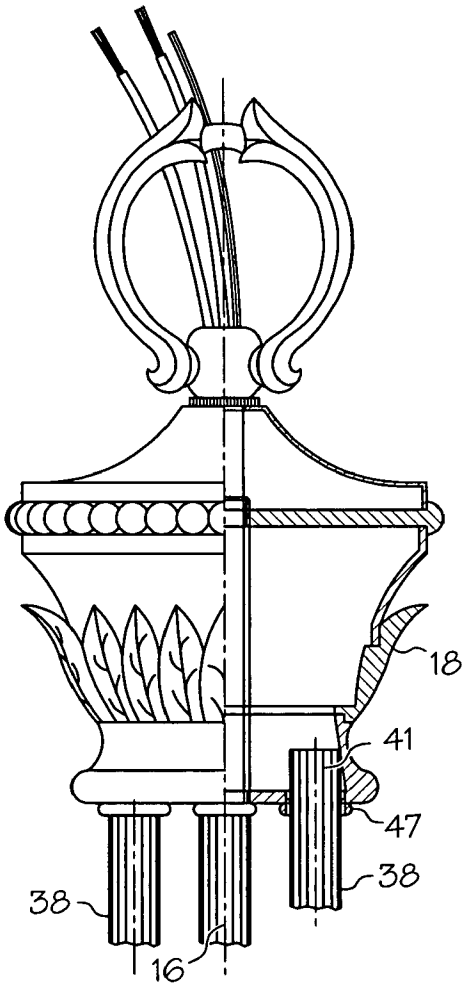
FIGS. 4A, 4B and 4C are an exploded side view, a side view and a perspective view, respectively, of the collapsible chandelier of FIGS. 1 and 2 showing the upper end of a decorative cross-member being received in the upper hub of the chandelier.
Figure 4A:
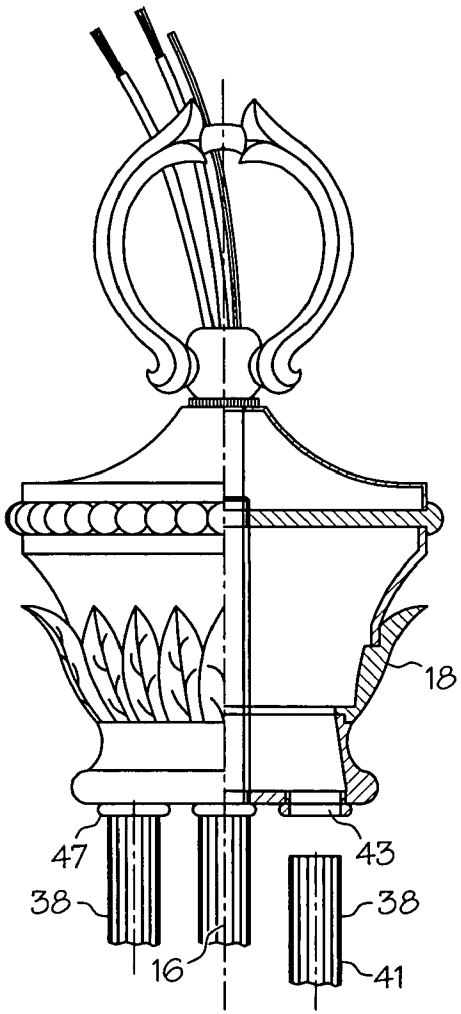
Figure 4C:
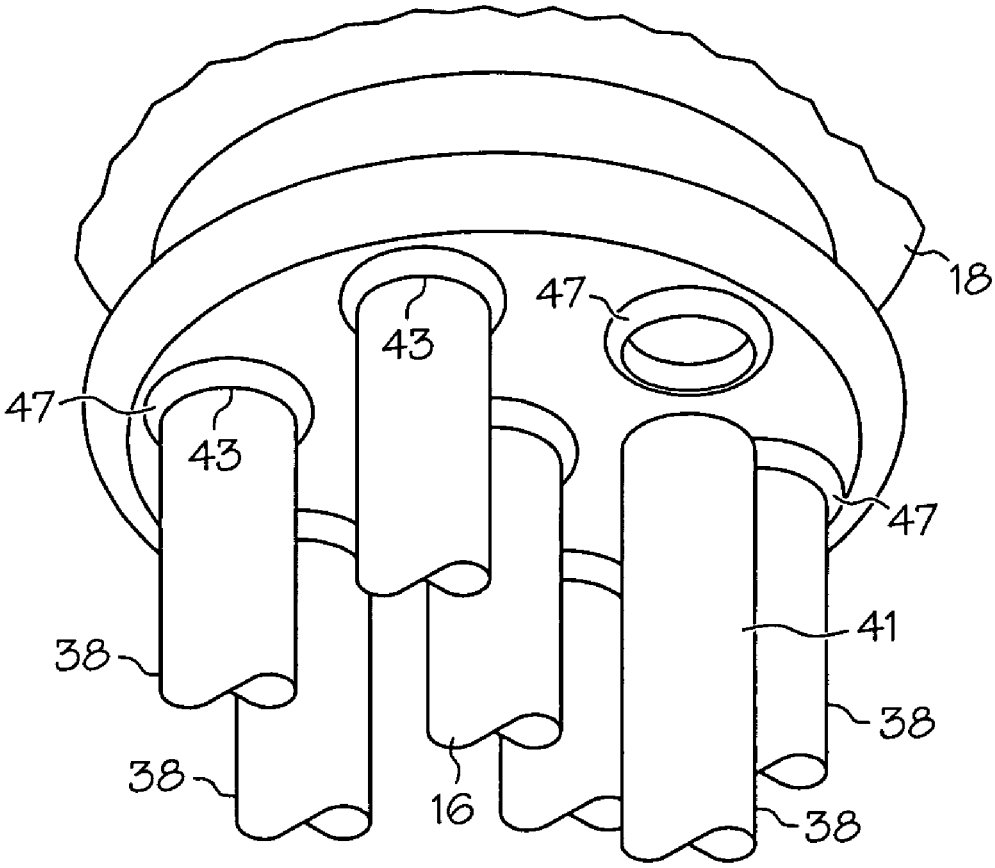
Figure 5:
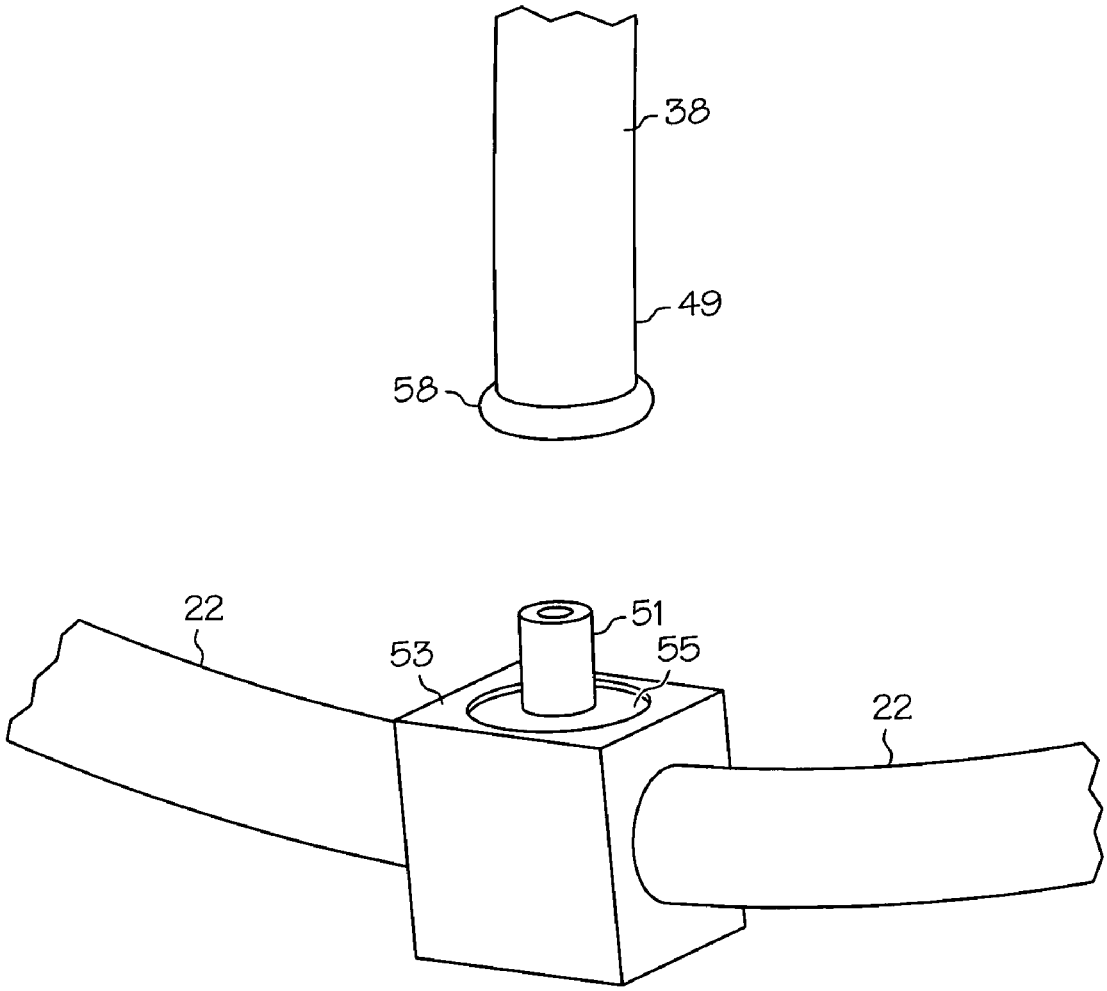
FIG. 5 is another perspective view of the collapsible chandelier of FIGS. 1 and 2 showing the decorative cross-member of FIGS. 4A, 4B and 4C being attached to an intermediate section of its associated lamp arm.

As shown in FIGS. 3A and 3B, the attaching portion 73 of each lamp arm, i.e. the portion of each lamp arm at or near its proximal end 77 where the lamp arm is attached to the support hub, is in the form of a hollow conduit section. In addition, the mounting assembly 63 which pivotally mounts the lamp arm to the support hub defines a pivotal axis 29 which is generally perpendicular to the longitudinal axis 79 of this hollow conduit section. This results in enhanced structural integrity. This is because an entire 360° of conduit wall is present at the intersection of pivotal axis 29 and attaching portion 73 of lamp arm 22 where the moment created by pull of gravity on the lamp arm is highest. Thus, greater structural integrity is achieved relative to earlier designs in which the portion of the lamp arm pivotally attaching to the support hub was defined by a single essentially flat wall or other essentially planar structure.

In the particular embodiment shown, conduit section 73 is essentially square in cross-section. However, any other cross-sectional shape can also be used including non-square rectangular, circular, elliptical, etc.

Referring again to FIGS. 3A and 3B, support hub 26 includes a mounting flange 98 to which pivotal mounting assembly 63 is attached. In the particular embodiment shown, mounting assembly 63 includes pivot shaft 93 in the form of an externally threaded hollow nipple, the upper end of which is secured to mounting flange 98 by hex nut 101 and lock washer 103. Meanwhile, the lower end of pivot shaft 93 is threadedly received in annular bead 107, which is rigidly secured to the first or "upper" conduit wall 109 of conduit section 73. Glue, solder, welding, lock washers or other conventional systems may be used to lock pivot shaft 93 to annular bead 107, if desired. The nut 101 and a lock washer 103 fasten each arm 22 to the hub 14 preventing axial movement of each arm 22 relative to the base hub 14; however, each arm 22, may still rotate relative to the hub 14 if sufficient force is provided by hand or with a tool.

In the particular embodiment shown, the lower end of pivot shaft 93 terminates in annular bead 107, which is rigidly secured to upper conduit wall 109 by welding, brazing or the like. In another exemplary embodiment, the lower end of pivot shaft 93 can penetrate upper conduit wall 109 and be secured thereto by another nut and washer or other mechanical fastener. In still another exemplary embodiment, the lower end of pivot shaft 93 can penetrate both upper conduit wall 109 and lower conduit wall 111 and be secured to the lower conduit wall by thereto by a nut and washer or other mechanical fastener. In all of these embodiments, electrical wire 57 can be fed through hollow nipple 93 for connection to the socket on the distal end of the lamp arm, if desired. Moreover, in all of these embodiments hollow conduit section 73 of lamp arm 22 can have any cross-sectional configuration, it being understood that "upper and "lower" conduit walls in this context refers to the portions of the conduit walls which intersect pivotal axis 29 adjacent to and remote from mounting flange 98, respectively.

In any event regardless of which design is used, it is desirable for providing enhanced structural integrity that proximal end 77 of lamp arm 22 extend passed pivot shaft 93 by enough distance so that upper conduit wall 109 bears on annular bead 107 throughout its 360° of circumference. Thus, it is desirable that the proximal end 77 of lamp arm 22 extend away from pivot axis 29 of pivotal mounting assembly 63 by a distance which is greater than the outside radius of pivot shaft 93.

To conceal the interface between the upwardly facing rim 28 and the downwardly facing rim 30 of hub 14, in the embodiment shown the upwardly facing rim 28 and the downwardly facing rim 30 cooperate to form a groove 120 that is spaced from and extends parallel to groove 122. Groove 122 is a masking design element and as shown in FIG. 3A, the grooves 120, 122 are symmetrically spaced with respect to the external configuration of the structure formed by bracket 26/hub 14.

The stabilizer 26 may be held in place by any of a number of suitable means. For example, in the embodiment shown, the stabilizer 26 is held in place by a finial ball 124 and a threaded nipple 126 via a break (decorative trim) 128. The nipple 126 may be secured to the hub 14 by a coupling 130 secured by a hex nut 132. For shipping, the hex nut 132, the nipple 126, the decorative trim 128, and the finial ball 124 may be removed to permit the arms 22 to be moved to the storage configuration. The plate 98 may be connected to the upright 16 via a coupling 140, a nipple 142, a hickey (which may be a barrel hickey) 144, and another nipple 146, which may be connected to coupling 130 through an opening in the plate 98. The hub 14 may have an associated grounding terminal 148 and grounding wire 150.

In order to provide additional visual interest, each lamp arm 22 of chandelier 10 is also provided with optional cross members 38. See, FIG. 1. In the particular embodiment shown, cross member 38 takes the form of a fluted rod whose upper end 41 is slidably received in a corresponding downwardly facing opening 43 in secondary or upper hub 18. See, FIGS. 4A, 4B and 4C. An upper ring-shaped bead 47 surrounds each opening 43 to give the appearance that the bead 47 is rigidly secured to cross member 38 and, therefore, the appearance that the upper end of cross member 38 is rigidly secured to upper hub 18, even though it is not.

Meanwhile, the lower end 49 of each cross member 38 is attached to a connector 51 in intermediate section 53 of the corresponding lamp arm 22. See, FIG. 5. As shown in this figure, connector 51 in the particular embodiment shown takes the form of a nipple which projects from intermediate section 53 and may be sized to closely fit the inside diameter of fluted rod 38, so that lower end 39 of this fluted rod 38 can be securely joined to lamp arm 22 by gravity simply by fitting it over this nipple. To make it appear that the lower end 49 of fluted rod 38 is rigidly secured to lamp arm 22, and to center the lower end 49 with respect to the nipple 51, lower ring-shaped bead 58 is provided at the very end of fluted rod 38 while intermediate section 53 is countersunk slightly at the base 55 of nipple 51 to receive a portion of bead 58 therein when fluted rod 38 rests on lamp arm 22. Typically, intermediate section 53 is countersunk to receive 10–50%, more typically 20–40%, of bead 58. The result is that, while fluted rod 38 in the particular embodiment shown is held in position by gravity only and hence easily removable and reinsertable by raising fluted rod 38 to clear nipple 51, it projects the appearance of being rigidly secured to and integral with the remainder of the chandelier.

Figure 8:
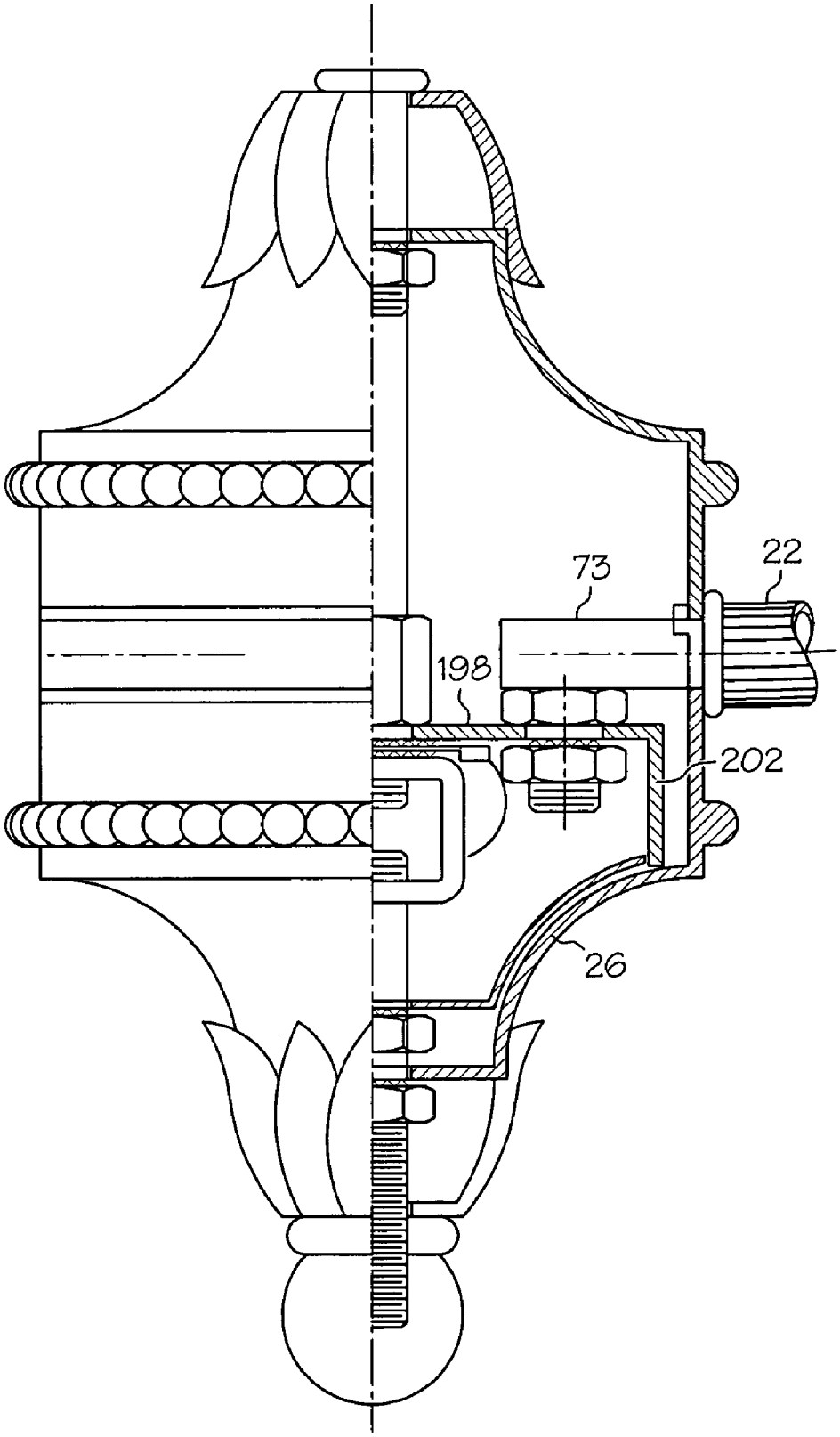
FIG. 8 is a side view similar to FIG. 3A showing another embodiment of the inventive collapsible chandelier in which the lamp arms are pivotally secured above rather than below the mounting flange of the support hub.

FIG. 8 shows an additional exemplary embodiment of the inventive collapsible chandelier in which hollow conduit section 73 of lamp arm 22 is pivotally attached to the upper surface of mounting flange 198 rather than to its lower surface as in previous embodiments. In addition, mounting flange 198 in this embodiment is formed by the roof of support member 202, which is provided for stabilizing bracket 26.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the teachings herein may be used with virtually any type of lighting products (fixtures or portables). Moreover, the steps of the methods described and claimed in the present application may be performed in any suitable order. Therefore, the invention in its broader aspects is not limited to the specific details, representative apparatus and methods, and illustrative examples shown and described. Accordingly, departures may be made from such details without departing from the spirit or scope of the applicant's general inventive concept.

The invention claimed is:

1. A collapsible chandelier comprising an upright arranged to be in a generally vertical orientation when the chandelier is in its use configuration, a support hub attached to the upright, and multiple lamp arms having distal ends for receiving lamp sockets, the lamp arms defining attaching portions at or near their proximal ends for pivotal attachment to the support hub so that the lamp arms are moveable between use positions and a storage position in which an overall dimension of the chandelier is reduced, wherein the attaching portion of at least one lamp arm is in the form of a hollow conduit section, this hollow conduit section being pivotally attached to the support hub by means of a pivotal mounting assembly defining a pivot axis arranged essentially perpendicular to the central axis of the hollow conduit section, and further wherein the hollow conduit section defines first and second conduit walls which are generally perpendicular to and intersect the pivot axis.

2. The collapsible chandelier of claim 1, wherein the hollow conduit section is generally rectangular or square in cross-section.

3. The collapsible chandelier of claim 1, wherein the hollow conduit section is generally circular or elliptical in cross-section.

4. The collapsible chandelier of claim 1, wherein the pivotal mounting assembly includes a pivot shaft defining a radius essentially perpendicular to the pivot axis, and further wherein the first and second conduit walls extend passed the pivotal axis by a distance which is greater than this radius.

5. The collapsible chandelier of claim 4, wherein the pivot shaft penetrates both the first and second conduit walls.

6. The collapsible chandelier of claim 4, wherein the pivot shaft penetrates only the first conduit wall.

7. The collapsible chandelier of claim 4, wherein the pivot shaft penetrates neither the first nor second conduit walls.

8. The collapsible chandelier of claim 7, wherein the pivotal mounting assembly further includes an annular bead fixed to the first conduit wall, the pivotal shaft being secured to this annular bead.

9. The collapsible chandelier of claim 4, wherein the pivot shaft is a hollow nipple and further wherein an electrical wire passes through this hollow nipple.

10. The collapsible chandelier of claim 4, wherein the support hub includes a mounting flange arranged generally perpendicular to the pivot axis of the pivot assembly, the at least one lamp arm being pivotally mounted on the mounting flange.

11. A collapsible chandelier comprising an upright arranged to be in a generally vertical orientation when the chandelier is in its use configuration, multiple lamp arms having distal ends for receiving lamp sockets, proximal ends attached to a lower portion of the upright, and intermediate sections therebetween, a secondary hub attached to the upright above the proximal ends of the lamp arms, a cross-member extending between each lamp arm and the secondary hub, the upper end of each cross-member being received in a corresponding downwardly facing opening in the secondary hub, the lower end of each cross-member being attached to a corresponding connector in the intermediate section of its respective lamp arm.

12. The collapsible chandelier of claim 11, wherein the lower end of the cross-member is a hollow conduit section, wherein the upper end of each cross-member is slidably received in a corresponding downwardly facing opening in the secondary hub, and wherein the connector is an upwardly projecting nipple so that so that the lower end of the cross-member can be securely joined to the intermediate section of it associated lamp arm by gravity by fitting it over this nipple.

13. The collapsible chandelier of claim 12, wherein a lower ring-shaped bead is attached to the lower end of each cross-member, and further wherein the intermediate section of each lamp arm is countersunk at the base of the nipple, a portion of the lower ring-shaped bead being received in the countersink so that when the cross-member rests on the lamp arm the cross-member appears rigidly secured to the lamp arm even though it is held in position by gravity only.

14. The collapsible chandelier of claim 13, wherein the intermediate section of each lamp arm is countersunk to receive about 10–50% of the lower ring-shaped bead.

15. The collapsible chandelier of claim 14, wherein the intermediate section of each lamp arm is countersunk to receive about 20–40% of the lower ring-shaped bead.

16. The collapsible chandelier of claim 15, wherein each cross-member is a fluted rod.

* * * * *